US008742653B2

(12) United States Patent
Kodama et al.

(10) Patent No.: US 8,742,653 B2
(45) Date of Patent: Jun. 3, 2014

(54) SPARK PLUG AND METAL SHELL FOR SPARK PLUG

(75) Inventors: Kazuhiro Kodama, Hekinan (JP); Hiroaki Nasu, Gifu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/822,052

(22) PCT Filed: Aug. 8, 2011

(86) PCT No.: PCT/JP2011/004492

§ 371 (c)(1),
(2), (4) Date: Mar. 11, 2013

(87) PCT Pub. No.: WO2012/035701

PCT Pub. Date: Mar. 22, 2012

(65) Prior Publication Data

US 2013/0175917 A1 Jul. 11, 2013

(30) Foreign Application Priority Data

Sep. 15, 2010 (JP) ..... 2010-206329

(51) Int. Cl.
*H01T 13/00* (2006.01)
*H01T 13/20* (2006.01)

(52) U.S. Cl.
USPC ..... 313/141; 313/118; 313/140; 313/142

(58) Field of Classification Search
None
See application file for complete search history.

(56) References Cited

U.S. PATENT DOCUMENTS

| | | | | |
|---|---|---|---|---|
| 6,768,249 | B1 * | 7/2004 | Nasu et al. | 313/118 |
| 6,809,463 | B2 * | 10/2004 | Suzuki | 313/141 |
| 7,122,947 | B2 * | 10/2006 | Nasu et al. | 313/141 |
| 8,593,046 | B2 * | 11/2013 | Kodama et al. | 313/141 |
| 2003/0155850 | A1 | 8/2003 | Suzuki | 313/143 |
| 2013/0175917 | A1 * | 7/2013 | Kodama et al. | 313/141 |

FOREIGN PATENT DOCUMENTS

| | | | |
|---|---|---|---|
| JP | 2002-184552 | 6/2002 | H01T 13/36 |
| JP | 2003-257584 | 9/2003 | H01T 13/36 |

OTHER PUBLICATIONS

International Search Report for International Application No. PCT/JP2011/004492, Oct. 25, 2011.

* cited by examiner

*Primary Examiner* — Natalie Walford
(74) *Attorney, Agent, or Firm* — Kusner & Jaffe

(57) ABSTRACT

An adhesion of a nickel plating layer to a metal shell is improved, and an effect of improving a corrosion resistance by providing the nickel plating layer is sufficiently exerted. A spark plug 1 includes a cylindrical metal shell 3 that extends in an axial CL1 direction, and a nickel plating layer 31 that is made of metal containing nickel as a main component and covers an outer surface of the metal shell. In a monochrome image of 256 gradations where black is 0 and white is 255, which is obtained by observing a cross-section perpendicular to an outer surface of the nickel plating layer by a transmission electron microscope with an acceleration voltage of 200 kV, an average value in 256 gradations of the monochrome image is 170 or larger and 230 or smaller.

8 Claims, 3 Drawing Sheets

(a)

(b)

SPARK PLUG AND METAL SHELL FOR SPARK PLUG

FIELD OF THE INVENTION

The present invention relates to a spark plug used in, for example, an internal combustion engine, and a metal shell for the spark plug.

BACKGROUND OF THE INVENTION

A spark plug is installed to, for example, an internal combustion engine (engine), and used for igniting an air-fuel mixture within a combustion chamber. In general, the spark plug includes an insulator having a shaft hole, a center electrode that is inserted through a leading end side of the shaft hole, a metal shell that is disposed in an outer periphery of the insulator, and a ground electrode that is joined to the metal shell and forms a spark discharge gap between the center electrode. The metal shell and the insulator are fixed by engaging a stepped portion formed at an outer periphery of the insulator with a stepped portion formed at an inner periphery of the metal shell and then bending a rear end of the metal shell inward in a radial direction.

Further, for the purpose of improving a corrosion resistance, a nickel plating layer may be disposed on a surface of the metal shell on which the ground electrode is welded (for example, refer to JP-A-2002-184552, "Patent Reference 1").

SUMMARY OF THE INVENTION

Problem that the Invention is to Solve

Meanwhile, a plating process to the metal shell is performed before the metal shell and the insulator are fixed to each other. That is, when the metal shell and the insulator are fixed to each other, the rear end of the metal shell is bent in a state where the nickel plating layer is disposed on a surface of the rear end. For that reason, a stress due to the bend causes a risk that the nickel plating layer floats or is peeled off from the surface of the metal shell, resulting in concern that the corrosion resistance is lessened.

The present invention has been made in view of the above circumstances, and an object of the present invention is to provide a spark plug and a metal shell for the spark plug, in which adhesion of the nickel plating layer to the metal shell is improved, thereby sufficiently exerting an effect of improving the corrosion resistance by providing the nickel plating layer.

Means for Solving the Problem

Hereinafter, respective configurations suitable for solving the above object will be described for each item. The effects specific to the corresponding configuration will be noted as necessary.

Configuration 1

In this configuration, there is provided a spark plug including: a cylindrical metal shell that extends in an axial direction; and a nickel plating layer that is made of metal containing nickel as a main component and covers an outer surface of the metal shell, wherein in a monochrome image of 256 gradations where black is 0 and white is 255, which is obtained by observing a cross-section perpendicular to an outer surface of the nickel plating layer by a transmission electron microscope with an acceleration voltage of 200 kV, an average value in the 256 gradations of the monochrome image is 170 or larger and 230 or smaller.

From the viewpoints of improving the adhesion of the nickel plating layer and further improving the corrosion resistance, it is more preferable that the average value in the 256 gradations of the monochrome image is 180 or larger and 220 or smaller.

Configuration 2

In this configuration, there is provided the spark plug according to the configuration 1, wherein in the cross-section perpendicular to the outer surface of the nickel plating layer, an average value of cross-sectional areas of respective crystal grains configuring the nickel plating layer is 0.002 $\mu m^2$ or larger and 0.035 $\mu m^2$ or smaller and a standard deviation of the cross-sectional areas of the respective crystal grains is 0.002 $\mu m^2$ or larger and 0.045 $\mu m^2$ or smaller.

In order to further improve the adhesion of the nickel plating layer, it is more preferable that the average value of the cross-sectional areas of the respective crystal grains is 0.005 $\mu m^2$ or larger and 0.025 $\mu m^2$ or smaller and the standard deviation of the cross-sectional areas of the respective crystal grains is 0.003 $\mu m^2$ or larger and 0.035 $\mu m^2$ or smaller.

Configuration 3

In this configuration, there is provided the spark plug according to the configuration 1 or 2, wherein in the cross-section perpendicular to the outer surface of the nickel plating layer, an average value of lengths of outlines of the respective crystal grains configuring the nickel plating layer is 0.2 μm or larger and 0.9 μm or smaller and a standard deviation of the lengths of the outlines of the respective crystal grains is 0.1 μm or larger and 0.8 μm or smaller.

In order to further improve the adhesion, it is more preferable that the average value of the lengths of the outlines of the respective crystal grains is 0.3 μm or larger and 0.7 μm or smaller and the standard deviation of the lengths of the outlines of the respective crystal grains is 0.2 μm or larger and 0.6 μm or smaller.

Configuration 4

In this configuration, there is provided the spark plug according to any one of the configurations 1 to 3, wherein in the cross-section perpendicular to the outer surface of the nickel plating layer, an average value of aspect ratios, which are obtained by dividing a major axis by a minor axis in a cross-section for each of the crystal grains configuring the nickel plating layer, is 1.00 or larger and 2.50 or smaller.

In order to further improve the adhesion, it is more preferable that the average value of the aspect ratios of the respective crystal grains is 1.25 or larger and 2.10 or smaller.

Configuration 5

In this configuration, there is provided a metal shell for a spark plug, the metal shell assuming a cylindrical shape, extending in an axial direction, and including: a nickel plating layer that is made of metal containing nickel as a main component, and covers an outer surface of the metal shell, wherein in a monochrome image of 256 gradations where black is 0 and white is 255, which is obtained by observing a cross-section perpendicular to an outer surface of the nickel plating layer by a transmission electron microscope with an acceleration voltage of 200 kV, an average value in the 256 gradations of the monochrome image is 170 or larger and 230 or smaller.

Configuration 6

In this configuration, there is provided the metal shell for a spark plug according to the configuration 5, wherein in the cross-section perpendicular to the outer surface of the nickel plating layer, an average value of cross-sectional areas of respective crystal grains configuring the nickel plating layer is 0.002 $\mu m^2$ or larger and 0.035 $\mu m^2$ or smaller and a standard deviation of the cross-sectional areas of the respective crystal grains is 0.002 $\mu m^2$ or larger and 0.045 $\mu m^2$ or smaller.

Configuration 7

In this configuration, there is provided the metal shell for a spark plug according to the configurations 5 or 6, wherein in the cross-section perpendicular to the outer surface of the nickel plating layer, an average value of lengths of outlines of the respective crystal grains configuring the nickel plating layer is 0.2 μm or larger and 0.9 μm or smaller and a standard deviation of the lengths of the outlines of the respective crystal grains is 0.1 μm or larger and 0.8 μm or smaller.

Configuration 8

In this configuration, there is provided the metal shell for a spark plug according to any one of the configurations 5 to 7, wherein in the cross-section perpendicular to the outer surface of the nickel plating layer, an average value of aspect ratios, which are obtained by dividing a major axis by a minor axis in a cross-section for each of the crystal grains configuring the nickel plating layer, is 1.00 or larger and 2.50 or smaller.

Advantageous Effects of the Invention

According to the spark plug of the configuration 1, in the monochrome image of 256 gradations where black is 0 and white is 255, which is obtained by observing the cross-section perpendicular to the outer surface of the nickel plating layer by the transmission electron microscope with the acceleration voltage of 200 kV, the average value of the density is 170 or larger and 230 or smaller. In this example, the nickel plating layer is formed by stacking crystal grains in layers. Most of the crystal grains are oriented in a (100) face, and the average value of the monochrome image becomes larger (that is, closer to white) as the asperity in the grain boundary of the respective layered crystal grains (crystal layers) is smaller. On the contrary, the average value of the monochrome image becomes smaller (that is, closer to black) as the number of crystal grains oriented in the (100) face is smaller, and the asperity in the grain boundary of the respective crystal layers is larger. Also, a thin portion is more likely to be formed in a portion of the crystal layer as the asperity on the grain boundary is larger.

According to the spark plug of the above configuration 1, the average value in the 256 gradations of the monochrome image is 170 or larger and is relatively large. Therefore, the asperity in the grain boundary becomes sufficiently small. Accordingly, a portion of the crystal layer can be surely prevented from being thinned, and when a stress is exerted on the nickel plating layer, for example, in an occasion of bending the rear end portion of the metal shell, the respective crystal layers can sufficiently absorb the stress.

Also, the average value in the 256 gradations of the monochrome image 230 or smaller, and asperity in the grain boundary is prevented from being extremely lessened. Accordingly, contact area between the respective crystal layers can be sufficiently ensured, and the grain boundary coupling force can be sufficiently increased. As a result, the floating and peeling off of the crystal layers when the stress is applied thereto can be suppressed.

As described above, according to the spark plug of the above configuration 1, the stress can be more surely absorbed by the respective crystal layers, and the peeling off of the crystal layers can be effectively suppressed. As a result, the adhesion of the nickel plating layer to the metal shell can be improved. Further, an effect of improving the corrosion resistance by providing the nickel plating layer can be sufficiently exerted.

According to the spark plug of the configuration 2, the average value of the cross-sectional areas of the respective crystal grains configuring the nickel plating layer is 0.035 $\mu m^2$ or smaller and the standard deviation of the cross-sectional areas of the respective crystal grains is 0.002 $\mu m^2$ or larger and 0.045 $\mu m^2$ or smaller. That is, the crystal grains configuring the nickel plating layer are fine as a whole. Accordingly, the asperity of the grain boundary can be more decreased, and a portion of the crystal layer can be surely prevented from being thinned. As a result, when a stress is exerted on the nickel plating layer, the respective crystal layers can further absorb the stress.

Also, the average value of the cross-sectional areas of the respective crystal grains is 0.002 $\mu m^2$ or larger and the crystal grains are prevented from being excessively made fine. As a result, the grain boundary coupling force can be more increased, and the adhesion of the nickel plating layer can be further improved together with the effect that the stress can be more surely absorbed as described above.

According to the spark plug of the configuration 3, the same effects as those in the above configuration 2 are obtained. That is, because the crystal grains are made fine to some degree as a whole, the stress can be more surely absorbed, and the grain coupling force can be further increased. As a result, the adhesion of the nickel plating layer can be further improved.

According to the spark plug of the configuration 4, substantially the same effects as those in the above configurations 2 and 3 are obtained. That is, the crystal grain is formed in a shape close to a circle, and the asperity on the grain boundary is sufficiently decreased. Accordingly, a portion of the crystal layer can be more surely prevented from being thinned, and the adhesion of the nickel plating layer can be further improved.

According to the spark plug of the configuration 5, in the metal shell for the spark plug, the same effects as those in the above configuration 1 are obtained.

According to the spark plug of the configuration 6, the same effects as those in the above configuration 2 are obtained.

According to the spark plug of the configuration 7, the same effects as those in the above configuration 3 are obtained.

According to the spark plug of the configuration 8, the same effects as those in the above configuration 4 are obtained.

DETAILED DESCRIPTION OF THE INVENTION

Figure 1:
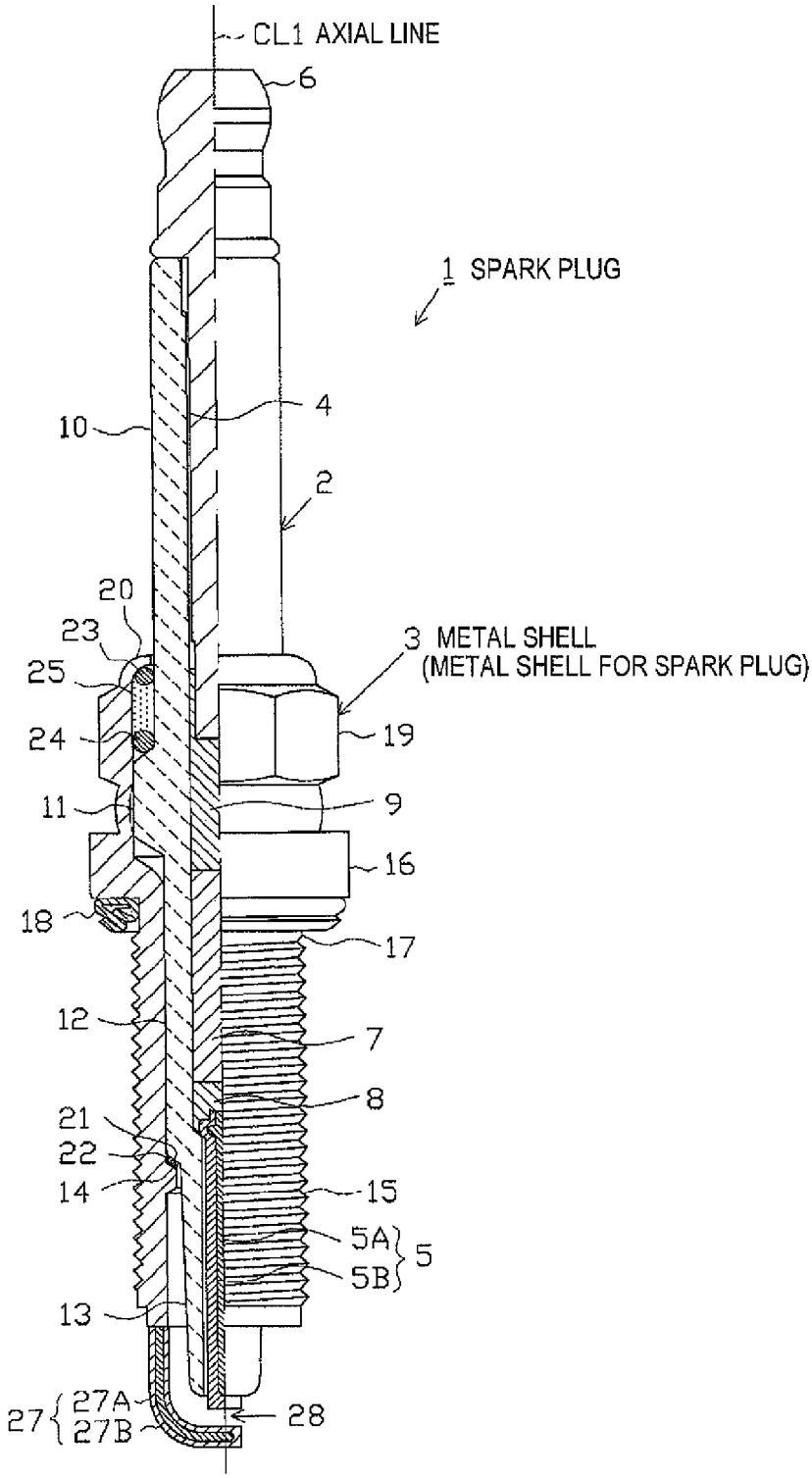
FIG. 1 is a partially broken front view illustrating a configuration of a spark plug according to an embodiment.

Hereinafter, an embodiment will be described with reference to the drawings. FIG. 1 is a partially broken front view illustrating a spark plug 1. In FIG. 1, a description will be given assuming that a direction of an axis CL1 of the spark plug 1 is a vertical direction in the figure, a lower side is a front end side of the spark plug 1, and an upper side is a rear end side thereof.

The spark plug 1 includes a cylindrical insulator 2, a cylindrical metal shell 3 for the spark plug (hereinafter referred to as "metal shell") that holds the insulator, and so on.

The insulator 2 is formed by baking alumina as well known. An outline portion of the insulator includes a rear end side trunk portion 10 formed at the rear end side, a large-diameter portion 11 protruded outward in the radial direction, which is closer to the front end side than the rear end side trunk portion 10, a middle trunk portion 12 which has a thinner diameter than that of the large-diameter portion 11 and is formed at the front end side from the large-diameter portion 11, and a long leg portion 13 which has a thinner diameter than that of the middle trunk portion 12 and is closer to the front end side than the middle trunk portion 12. In addition, among the insulator 2, the large-diameter portion 11, the middle trunk portion 12, and most of the long leg portion 13 are accumulated inside of the metal shell 3. A tapered stepped portion 14 is formed at a connecting portion between the middle trunk portion 12 and the long leg portion 13, and the insulator 2 is engaged with the metal shell 3 at this stepped portion 14.

Further, an axial hole 4 is penetratingly formed in the insulator 2 along the axis CL1, and a center electrode 5 is inserted and fixed at a front end side of the axial hole 4. The center electrode 5 includes an inner layer 5A made of copper or copper alloy having high thermal conductivity and an outer layer 5B made of Ni-based alloy containing nickel (Ni) as a main component. Further, the center electrode 5 is formed in a bar shape (columnar shape) as a whole, and a front end surface of the center electrode 5 is flattened and protrudes from a front end of the insulator 2.

Also, a terminal electrode 6 is inserted and fixed in a rear end side of the axial hole 4 in a state where the terminal electrode 6 protrudes from a rear end of the insulator 2.

A columnar resistor 7 is disposed between the center electrode 5 and the terminal electrode 6 in the axial hole 4. Opposite end portions of the resistor 7 are electrically connected to the center electrode 5 and the terminal electrode 6 through electrically conductive glass seal layers 8 and 9, respectively.

In addition, the metal shell 3 is made of a metal such as low carbon steel and is formed a cylindrical shape. The metal shell has a threaded portion (externally threaded portion) 15 for installing the spark plug 1 in a mounting hole of a combustion device (for example, an internal combustion engine or a fuel battery reformer) on an outer peripheral surface thereof. Also, a seat portion 16 is formed on an outer peripheral surface of the rear end side of the threaded portion 15, and a ring-like gasket 18 is fitted to a thread neck 17 at the rear end of the threaded portion 15. Further, at the rear end side of the metal shell 3, there are provided a tool engaging portion 19 with a hexagonal cross-sectional shape for engaging a tool, such as a wrench, at the time of installing the metal shell 3 in the combustion device, and a crimped portion 20 for holding the insulator 2 at the rear end portion.

In addition, a tapered stepped portion 21 for engaging the insulator 2 is provided to an inner peripheral surface of the metal shell 3. The insulator 2 is inserted from the rear end side of the metal shell 3 toward the front end side thereof. In a state in which the stepped portion 14 of the insulator 2 is engaged with the stepped portion 21 of the metal shell 3, an opening portion at the rear end side of the metal shell 3 is crimped radially inward, that is, the above crimped portion 20 is formed, to thereby fix the insulator 2. An annular plate packing 22 is interposed between respective stepped portions 14 and 21 of the insulator 2 and the metal shell 3. This ensures that the gas-tightness of the interior of a combustion chamber is maintained, and that a fuel gas entering a gap between the long leg portion 13 of the insulator 2 and the inner peripheral surface of the metal shell 3, which is exposed to the interior of the combustion chamber, does not leak to the outside.

In addition, for the purpose of bringing the gas-tightness due to more perfect crimping, annular ring members 23 and 24 are interposed between the metal shell 3 and the insulator 2 at the rear end side of the metal shell 3, and a space between the ring members 23 and 24 is filled with powders of a talc (talc) 25. That is, the metal shell 3 holds the insulator 2 through the plate packing 22, the ring members 23, 24, and the talc 25.

In addition, a ground electrode 27 is joined to a front end portion of the metal shell 3 such that its middle portion is folded back to cause a side surface of its front end portion to oppose the front end portion of the center electrode 5. The ground electrode 27 includes an outer layer 27A made of. Ni-based alloy [for example, inconel 600 or inconel 601 (both registered trademark)], and an inner layer 27B made of copper alloy or pure copper which is a metal higher in thermal conductivity than the above Ni-based alloy.

In addition, a spark discharge gap 28 is formed between the front end portion of the center electrode 5 and the front end portion of the ground electrode 27. A spark discharge is generated in the spark discharge gap 28 substantially along the axis CL1.

Figure 2:
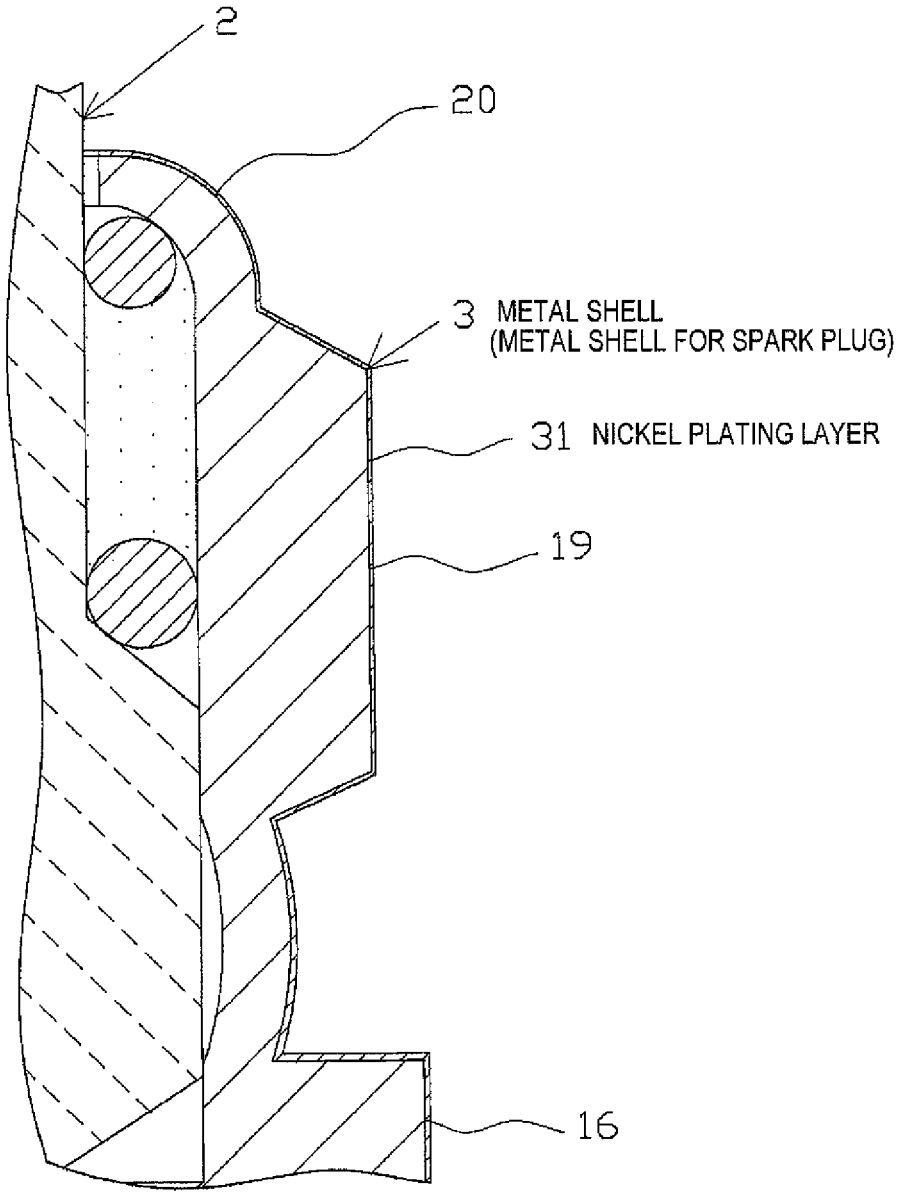
FIG. 2 is a partially enlarged cross-sectional view illustrating a configuration of a nickel plating layer.

Also, as illustrated in FIG. 2, a nickel plating layer 31 made of metal containing Ni as a main component is disposed on a surface of the metal shell 3 (in FIG. 2, the nickel plating layer 31 is shown thicker than normal for convenience of illustration). The nickel plating layer 31 has a predetermined thickness (for example, 5 μm to 15 μm), and is formed on an entire surface of the metal shell 3.

In addition, the nickel plating layer 31 in this embodiment is configured to satisfy the following conditions. That is, a cross-section (at least a cross-section falling within 2 μm from the surface of the nickel plating layer 31) perpendicular to an outer surface of the nickel plating layer 31 is observed by a transmission electron microscope (TEM) using an acceleration voltage of 200 kV. When the observed cross-sectional image is a monochrome image of 256 gradations where black is 0 gradation and white is 255 gradations, an average value of the 256 gradations of the monochrome image is 170 or larger and is 230 or smaller (more preferably 180 or larger and 220 or smaller). The nickel plating layer 31 is formed by stacking crystal grains in layers. If an asperity is small at a grain boundary of the respective crystal grains (crystal layers) in the layers, the average value of the monochrome image becomes larger, and as the asperity is larger at the grain boundary of the respective crystal layers, the average value of the monochrome image becomes smaller. In this embodiment, the average value of 256 gradations of the monochrome image is 170 or larger and 230 or smaller, which is relatively large, and the grain boundary of the crystal layer configuring the nickel plating layer 31 has a slight asperity, but is substantially flat.

In measuring the average value of 256 gradations of the monochrome image in the cross-section of the nickel plating layer 31, the following technique can be used. That is, the nickel plating layer 31 is cut along a direction perpendicular to the outer surface of the nickel plating layer 31 by a focused ion beam (FIB) processing device to obtain a thin section including the nickel plating layer 31. Then, the thin section obtained in an area of 10 μm along the thickness direction of the nickel plating layer 31 by 20 μm along a direction perpendicular to the thickness direction is observed by the TEM using the acceleration voltage of 200 kV. An area of 7 μm×7

μm including the nickel plating layer 31 within the above area is imaged. Then, an area falling within 2 μm inward from the outer surface of the nickel plating layer 31 (7 μm in width) is extracted from the captured image with the use of a predetermined image software (for example, paint). Then, the extracted image (extracted image) is subjected to 8-bit conversion by a predetermined analysis software (for example, ImageJ: National Institutes of Health), thereby being converted into a monochrome image of 256 gradations. The obtained monochrome image is analyzed by the above analysis software to measure the average value in the 256 gradations. This makes it possible to measure the average value in the 256 gradations of the monochrome image in the cross-section of the nickel plating layer 31. As the FIB, there can be applied, for example, a focused ion beam processing device made by HITACHI, LTD (Model No. FB-2000). As the TEM, there can be applied, for example, a transmission electron microscope made by HITACHI, LTD (Model No. HD-2000).

Further, in the cross-section perpendicular to the outer surface of the above nickel plating layer 31, the average value of cross-sectional area of the respective crystal grains configuring the nickel plating layer 31 is 0.002 $\mu m^2$ or larger and 0.035 $\mu m^2$ or smaller (more preferably, 0.005 $\mu m^2$ or larger and 0.0025 $\mu m^2$ or smaller). Also, a standard deviation of the cross-sectional area of each crystal grain is 0.002 $\mu m^2$ or larger and 0.045 $\mu m^2$ or smaller (more preferably, 0.003 $\mu m^2$ or larger and 0.0035 $\mu m^2$ or smaller). That is, the crystal grains are configured to be relatively small in the average value of the cross-sectional areas and relatively fine, but to be not excessively coarse.

Instead of setting the average value of the cross-sectional areas of each crystal grain configuring the nickel plating layer 31 to the above-mentioned numerical range, or in addition to setting the average value of the cross-sectional areas of the respective crystal grains to the above-mentioned numerical range, the average value of lengths (perimeters) of the outlines of the respective crystal grains configuring the nickel plating layer 31 may be 0.2 μm or larger and 0.9 μm or smaller (more preferably, 0.3 μm or larger and 0.7 μm or smaller) and the standard deviation of the lengths of the outlines of the respective crystal grains may be 0.1 μm or larger and 0.8 μm or smaller (more preferably, 0.2 μm or larger and 0.6 μm or smaller). Also, instead of setting the average value of the cross-sectional areas or the perimeters to the above-mentioned numerical range, or in addition to setting the average value of the cross-sectional areas or the perimeters to the above-mentioned numerical range, an average value of aspect ratios obtained by dividing major axes of the cross-sections of the respective crystal grains configuring the nickel plating layer 31 by minor axes may be 1.00 or larger and 2.50 or smaller (more preferably, 1.25 or larger and 2.10 or smaller).

The respective average values of the cross-sectional areas of the crystal grains, the lengths of the outlines of the crystal grains, and the aspect ratios of the crystal grains, and the standard deviation of the cross-sectional areas of the crystal grains can be measured as follows. That is, contours of the crystal grains (100 to 110 pieces) are transferred to a thin paper from the above-mentioned extracted images which are extracted in the area falling within 2 μm inward from the outer surface of the nickel plating layer 31. Then, the thin paper is scanned to obtain image data, and the image data is binarized by the predetermined image software (for example, paint). The binarized image data is analyzed by the predetermined analysis software (for example, ImageJ) to measure the cross-sectional areas of the respective crystal grains, the lengths of the outlines, and the aspect ratios. Then, the average values and the standard deviation of the measured data are calculated to measure the average values and the standard deviation of the cross-sectional areas of the crystal grains.

Subsequently, a description will be given of a method of manufacturing the spark plug 1 configured as described above. First, the metal shell 3 is processed in advance. That is, a cylindrical metallic material (for example, an iron-based material such as S17C or S25C or a stainless steel material) is subjected to cold forging to thereby form a through hole and create a rough form. Then, the rough form is subjected to cutting to arrange an outer shape, thereby obtaining an intermediate body of the metal shell.

Subsequently, the straight rod-shaped ground electrode 27 made of a Ni-based alloy is resistance welded to a front end face of the intermediate body of the metal shell. Since so-called sagging occurs in the welding, after the sagging is eliminated, the threaded portion 15 is formed at a predetermined portion of the intermediate body of the metal shell by rolling. As a result, the metal shell 3 with the ground electrode 27 welded thereto is obtained.

Further, the metal shell 3 with the ground electrode 27 welded thereto is subjected to plating by barrel plating, and the nickel plating layer 31 is formed on the outer surface of the metal shell 3. In the plating, there is used a barrel plating device (not shown) including a plating bath that stores an acid plating solution (pH is about 3 to 4) including nickel sulfate ($NiSO_4$), nickel chloride ($NiCl_2$), or boric acid ($H_3BO_3$), and a holding container that has a wall surface formed of a net or a perforated plate and is immersed in the plating solution. Specifically, the metal shell 3 is housed in the holding container, and the metal shell 3 is immersed in the plating solution. Then, while the holding container is rotated by a predetermined motor, DC current is allowed to flow into the metal shell 3 for a predetermined time, to thereby form the nickel plating layer 31 on the overall surface of the metal shell 3.

In forming the nickel plating layer 31 having the above-mentioned predetermined thickness, it is possible to lengthen an energization time while setting a current density of the DC current to be lower, or to shorten the energization time while setting the current density of the DC current to be higher.

In this case, when the energization time is lengthened while the current density of the DC current is set to be lower, the crystal grains configuring the nickel plating layer 31 uniformly adhere to the metal shell 3, and the asperity at the grain boundary of the crystal layer of the nickel plating layer 31 is small (that is, the number of crystal grains oriented in a (100) face is relatively large). On the contrary, when the energization time is shortened while the current density of the DC current is set to be higher, the crystal grains configuring the nickel plating layer 31 non-uniformly adhere to the metal shell 3, and the asperity at the grain boundary of the nickel plating layer 31 is relatively large (that is, the number of crystal grains oriented in a (110) face or a (111) face is relatively large). Further, when the energization time is lengthened, and the current density is set to be lower, the respective crystal grains configuring the nickel plating layer 31 grow uniformly, and the crystal grains are made fine. As a result, the cross-sectional areas, the perimeters, and the aspect ratios of the respective crystal grains become relatively small, and the respective crystal grains become substantially uniform in size. On the other hand, when the energization time is shortened, and the current density is set to be higher, the growth of the respective crystal grains becomes non-uniform, and the crystal grains are coarsened. As a result, the cross-sectional areas, the perimeters, and the aspect ratios of the respective crystal grains become relatively large, and the sizes of the respective crystal grains are varied.

Taking those facts into account, in this embodiment, in the plating, the energization time is relatively long (for example, 55 minutes or longer and 85 minutes or shorter) whereas the current density is relatively low (for example, 0.24 A/dm$^2$ or higher and 0.36 A/dm$^2$ or lower). As a result, the asperity on the grain boundary of the nickel plating layer 31 can be sufficiently reduced, and the cross-sectional areas, the perimeters, and the aspect ratios of the respective crystal grains configuring the nickel plating layer 31 can be relatively reduced. Also, the respective crystal grains can be formed in a substantially uniform size.

Meanwhile, the insulator 2 is fabricated in advance separately from the above-described metal shell 3. For example, green granules for molding are prepared from a raw material powder mainly containing alumina and also including a binder and the like, and a cylindrical compact is obtained by rubber press molding the green granules. The compact thus obtained is subjected to grinding, to thereby be shaped. The shaped compact is then baked into a baking furnace to obtain the insulator 2.

In addition, the center electrode 5 is fabricated in advance separately from the metal shell 3 and the insulator 2 mentioned above. That is, an Ni-based alloy in which copper alloy is provided in its central portion so as to improve radiation performance is subjected to forging to fabricate the center electrode 5.

Then, the center electrode 5, the terminal electrode 6, and the resistor 7 are sealed and fixed to the insulator 2 obtained as described above, by the glass seal layers 8 and 9. The glass seal layers 8 and 9 are generally prepared by mixing borosilicate glass and a metal powder. After the prepared mixture is poured into the axial hole 4 of the insulator 2 so as to sandwich the resistor 7, the prepared mixture is heated by the baking furnace while being pressed from the rear by the terminal electrode 6, to thereby seal and fix the center electrode 5. At this time, a glazing layer may be simultaneously baked on the surface of the rear end side trunk portion 10 of the insulator 2, or the glazing layer may be formed thereon beforehand.

Figure 3:
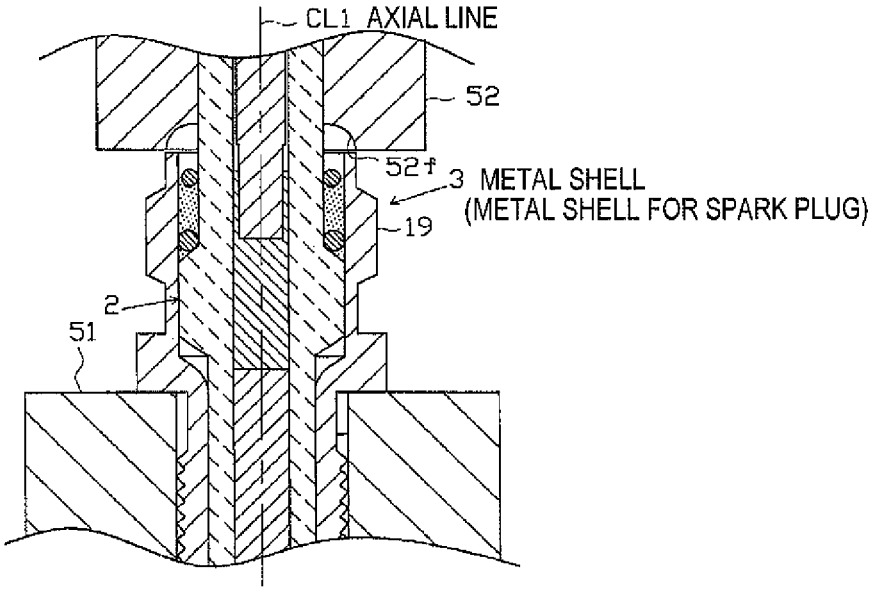
FIGS. 3(*a*) and 3(*b*) are cross-sectional views illustrating, for example, a metal shell, in one of processes of manufacturing the spark plug according to the embodiment.
Figure 3:
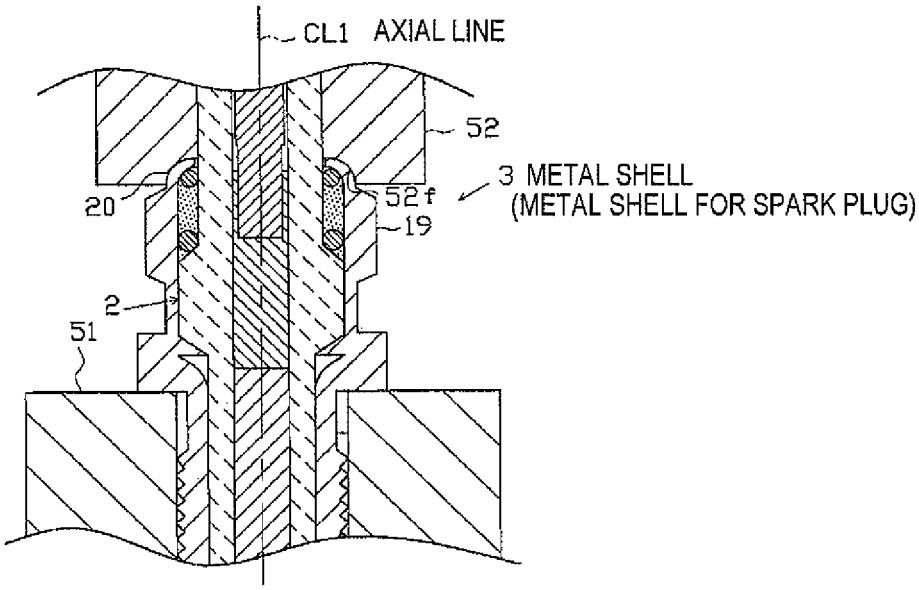

Subsequently, the insulator 2 having the center electrode 5 and the terminal electrode 6, and the metal shell 3 having the ground electrode 27 are fixed to each other by crimping. That is, as illustrated in FIG. 3(*a*), the front end side of the metal shell 3 is inserted into a first die 51 to hold the metal shell 3 by the first die 51. Then, a second die 52 is attached from above the metal shell 3. The second die 52 is cylindrically shaped, and has a curved surface portion 52*f* having a curved surface shape corresponding to the shape of the crimped portion 20.

After attaching the second die 52, the metal shell 3 is sandwiched by the first and second dies 51 and 52, and a pressing force is applied to the metal shell 3 along the direction of the axis CL1. As a result, as illustrated in FIG. 3(*b*), the rear end side opening portion of the metal shell 3 is crimped inward in the radial direction to form the crimped portion 20, and fix the insulator 2 and the metal shell 3 to each other.

Then, the ring-like gasket 18 is provided, and the ground electrode 27 is bent toward the center electrode 5 side. Finally, a size of the spark discharge gap 28 formed between the center electrode 5 and the ground electrode 27 is adjusted to obtain the above-mentioned spark plug 1.

As described in detail above, according to this embodiment, in the monochrome image of the 256 gradations where black is 0 gradation and white is 255 gradations, which is obtained when the cross-section perpendicular to the outer surface of the nickel plating layer 31 is observed by the transmission electron microscope with the acceleration voltage of 200 kV, the average value of gradation is 170 or larger. Accordingly, the asperity at the grain boundary of the crystal grains configuring the nickel plating layer 31 can be sufficiently reduced, and a portion of the crystal layer can be surely prevented from being thinned. As a result, when a stress is exerted on the nickel plating layer 31 such that the rear end portion of the metal shell 3 is bent, the respective crystal layers can sufficiently absorb the stress.

Also, the average value of the gradation image 230 or smaller, and thus, the asperity on the gain boundary is prevented from being excessively reduced. Accordingly, a contact area between the crystal layers can be sufficiently ensured, and a grain boundary bonding force can be sufficiently increased. As a result, the floating and peeling off of the crystal layers when the stress is applied thereto can be suppressed.

As described above, according to this embodiment, the stress can be more surely absorbed in the respective crystal layers, and the peeling off of the crystal layers can be effectively suppressed. As a result, the adhesion of the nickel plating layer 31 to the metal shell 3 can be improved. Further, an effect of improving the corrosion resistance by providing the nickel plating layer 31 can be sufficiently exerted.

Further, since any one of the average value of the cross-sectional areas of the respective crystal grains, the average value of the perimeters, and the average of the aspect ratios falls within the above-mentioned numerical value, the asperity of the grain boundary can be more reduced, and further, the contact area of the respective crystal layers can be further largely ensured. As a result, the stress can be further surely absorbed at the respective crystal layers, the grain boundary coupling force can be more increased, and the adhesion of the nickel plating layer 31 can be further improved.

For the purpose of confirming the effects obtained by the above embodiments, in the monochrome image of 256 gradations where black is 0 gradations and white is 255 gradations, which is obtained by observing the cross-section perpendicular to the outer surface of the nickel plating layer by the transmission electron microscope with the acceleration voltage of 200 kV, a plurality of samples of the metal shell in which the average value of gradation of the monochrome image is variously changed by changing the energization time or the current density at the time of conducting the plating process is prepared, and a plating adhesion test is performed to the respective samples. An outline of the plating adhesion test will be described hereinafter. That is, the above-mentioned crimping process is performed to the samples of the metal shell at room temperature to form the crimped portion to the samples of the metal shell and fix the respective samples and the insulator. Then, a state of the nickel plating layer at the formed crimped portion is observed, and examples in which the plating does not float or is not peeled off from the metal shell are given an evaluation of "●" as extremely excellent in the adhesion of plating to the metal shell. Also, examples in which the plating floats, but an area (floating area) of a portion where the plating floats is as sufficiently small as 5% or lower of the surface area of the crimped portion are given an evaluation of "○" as excellent in the adhesion. On the other hand, examples in which the floating area is 5% or larger but 10% or smaller of the surface area of the crimped portion are given an evaluation of "Δ" as slightly inferior in the adhesion, and an example in which the floating area exceeds 10% is given an evaluation of "x" as inferior in the adhesion.

Also, a corrosion resistance evaluation test is performed to the samples of the metal shell that has been formed with the crimped portion on the basis of a neutral salt spray test method prescribed in JIS H8502. That is, the respective samples are left in the atmosphere where salt water is sprayed for 48 hours, and it is confirmed whether a red rust is formed on a surface of the crimped portion or not. In this case, the samples in which the formation of the red rust is not confirmed is given the evaluation of "●" as extremely excellent in the corrosion resistance, and the samples in which an area of a portion where red rust (red rusted area) is formed is as sufficiently small as 5% or lower of the surface area of the crimped portion are given the evaluation of "○" as excellent in the corrosion resistance. On the other hand, examples in which the red rusted area is larger than 5% and 10% or smaller of the surface area of the crimped portion are given an evaluation of "Δ" as slightly inferior in the corrosion resistance.

Table 1 shows the test results of the plating adhesion test and the corrosion resistance evaluation test, respectively. Also, Table 1 shows the energization time and the current density at the time of performing the plating process. In the respective samples, the energization times and the current densities at the time of performing the plating process are identical with each other, and a test sample and a sample for measuring the average value of the gradation are prepared, respectively.

TABLE 1

| Average Value of Monochrome Image | Adhesion Evaluation | Corrosion Resistance Evaluation | Energization Time (min) | Current Density ($A/dm^2$) |
|---|---|---|---|---|
| 240 | x | ○ | 90 | 0.22 |
| 230 | ○ | ○ | 85 | 0.24 |
| 220 | ● | ● | 80 | 0.25 |
| 210 | ● | ● | 75 | 0.27 |
| 200 | ● | ● | 70 | 0.29 |
| 190 | ● | ● | 65 | 0.31 |
| 180 | ● | ● | 60 | 0.33 |
| 170 | ○ | ○ | 55 | 0.36 |
| 160 | Δ | Δ | 50 | 0.40 |
| 150 | Δ | Δ | 45 | 0.44 |

As shown in Table 1, it is apparent that a sample in which the average value of the monochrome image is 160 or smaller is slightly inferior in the adhesion and the corrosion resistance. Conceivably, this is because since the average value of the monochrome image is relatively small (that is, the asperity on the grain boundary is relatively large), a thin portion of the crystal layer is unavoidably formed, and when the stress attributable to the crimping process is exerted on the nickel plating layer, the stress cannot be sufficiently absorbed by the thin portion, and the plating floats above the thin portion.

Also, it is found that a sample in which the average value of the monochrome image is 240 is inferior in the adhesion. Conceivably, this is because since the average value of the monochrome image is very large (that is, the grain boundary of the crystal layer is extremely close to a flat state), the contact area of the respective crystal layers becomes excessively small, and as a result, the grain boundary coupling force is decreased.

On the contrary, it is apparent that samples in which the average value of the monochrome image 170 and 230 or smaller are excellent in both of the adhesion and the corrosion resistance. Conceivably, this is because the crystal layers are formed with a substantially equal thickness, and as a result, the stress attributable to the crimping is more surely absorbed by the respective crystal layers. This is also because the contact area of the respective crystal layers is sufficiently ensured with the result that the grain boundary coupling force is prevented from being lessened. This is further because the adhesion is improved by the above effects with the result that the corrosion resistance inherent to the nickel plating layer is sufficiently exerted.

Also, particularly, it is confirmed that samples in which the average value of the monochrome image 180 or larger and 220 or smaller are extremely excellent in both of the adhesion and the corrosion resistance.

From the above-mentioned test results, for the purpose of improving both of the adhesion and the corrosion resistance, the average value of the monochrome image in the cross-section of the nickel plating layer is preferably 170 or larger and 230 or smaller, and more preferably 180 or larger and 220 or smaller.

Subsequently, samples of the metal shell in which the average value of the cross-sectional areas (average cross-sectional area) of the crystal grains configuring the nickel plating layer in the cross-section perpendicular to the outer surface of the nickel plating layer, the average value of the perimeters (average perimeter) of the crystal grains, or the average value of the aspect ratios (average aspect ratio) of the crystal grains are variously changed are prepared. Then, after the samples are heated at 90° C. for 15 minutes (that is, in a state where the peeling off of the nickel plating layers is more likely to occur), the above-mentioned plating adhesion test is performed. In this case, in spite of conditions in which it is difficult to maintain the adhesion, examples in which the floating area is as extremely small as 5% or lower of the surface area of the crimped portion is given an evaluation of "●" as very excellent in the adhesion, and examples in which the floating area is 5% or larger but 10% or smaller of the surface area of the crimped portion are given an evaluation of "○" as excellent in the adhesion. On the other hand, examples in which the floating area exceeds 10% are given an evaluation of "Δ" as having a sufficient adhesion but slightly inferior in the adhesion as compared with other samples.

Also, to samples in which the average cross-sectional area, the average perimeter, or the average aspect ratio are variously changed, the above-mentioned corrosion resistance evaluation test is performed with a leaving time of 96 hours (that is, in a condition where the red rust is more likely to be formed). In this case, in spite of conditions in which the corrosion is very likely to be formed, examples in which the red rusted area is as extremely small as 5% or lower of the surface area of the crimped portion is given an evaluation of "●" as very excellent in the corrosion resistance, and examples in which the red rusted area is 5% or larger and 10% or smaller of the surface area of the crimped portion are given an evaluation of "○" as excellent in the corrosion resistance. On the other hand, examples in which the red rusted area exceeds 10% are given an evaluation of "Δ" as having a sufficient corrosion resistance but slightly inferior in the corrosion resistance as compared with other samples. In the respective samples, the average value of the monochrome image in the cross-section of the nickel plating layer is 170 or larger and 230 or smaller.

Table 2 illustrates the test results of both the tests to the samples in which the average cross-sectional area is changed, Table 3 illustrates the test results of both the tests to the samples in which the average perimeter is changed, and Table 4 illustrates the test results of both the tests to the samples in which the average aspect ratio is changed. Table 2 also shows the standard deviation of the cross-sectional areas of the respective crystal grains, and Table 3 also shows the standard deviation of the perimeter of the respective crystal grains. In addition, Tables 2 to 4 show the energization time and the current density at the time of performing the plating process.

TABLE 2

| Average Cross-Sectional Area ($\mu m^2$) | Standard Deviation ($\mu m^2$) | Adhesion Evaluation | Corrosion Resistance Evaluation | Energization Time (min) | Current Density ($A/dm^2$) |
|---|---|---|---|---|---|
| 0.001 | 0.001 | Δ | Δ | 85 | 0.24 |
| 0.002 | 0.002 | ○ | ○ | 83 | 0.24 |
| 0.005 | 0.003 | ● | ● | 80 | 0.25 |
| 0.010 | 0.010 | ● | ● | 75 | 0.27 |
| 0.015 | 0.020 | ● | ● | 70 | 0.29 |
| 0.020 | 0.030 | ● | ● | 65 | 0.31 |
| 0.025 | 0.035 | ● | ● | 60 | 0.33 |
| 0.030 | 0.040 | ○ | ○ | 58 | 0.34 |
| 0.035 | 0.045 | ○ | ○ | 55 | 0.36 |
| 0.040 | 0.050 | Δ | Δ | 50 | 0.40 |

TABLE 3

| Average Perimeter (μm) | Standard Deviation (μm) | Adhesion Evaluation | Corrosion Resistance Evaluation | Energization Time (min) | Current Density ($A/dm^2$) |
|---|---|---|---|---|---|
| 0.1 | 0.1 | Δ | Δ | 85 | 0.24 |
| 0.2 | 0.1 | ○ | ○ | 83 | 0.24 |
| 0.3 | 0.2 | ● | ● | 80 | 0.25 |
| 0.4 | 0.3 | ● | ● | 75 | 0.27 |
| 0.5 | 0.4 | ● | ● | 70 | 0.29 |
| 0.6 | 0.5 | ● | ● | 65 | 0.31 |
| 0.7 | 0.6 | ● | ● | 60 | 0.33 |
| 0.8 | 0.7 | ○ | ○ | 58 | 0.34 |
| 0.9 | 0.8 | ○ | ○ | 55 | 0.36 |
| 1.0 | 0.9 | Δ | Δ | 50 | 0.40 |

TABLE 4

| Average Aspect Ratio | Adhesion Evaluation | Corrosion Resistance Evaluation | Energization Time (min) | Current Density ($A/dm^2$) |
|---|---|---|---|---|
| 1.00 | ○ | ○ | 83 | 0.24 |
| 1.25 | ● | ● | 80 | 0.25 |
| 1.50 | ● | ● | 75 | 0.27 |
| 1.70 | ● | ● | 70 | 0.29 |
| 1.90 | ● | ● | 65 | 0.31 |
| 2.10 | ● | ● | 60 | 0.33 |
| 2.30 | ○ | ○ | 58 | 0.34 |
| 2.50 | ○ | ○ | 55 | 0.36 |
| 2.70 | Δ | Δ | 50 | 0.40 |

As shown in Tables 2 to 4, it is apparent that samples in which the standard deviation of the cross-sectional area is 0.002 $\mu m^2$ or larger and 0.045 $\mu m^2$ or smaller and the average cross-sectional area is 0.002 $\mu m^2$ or larger and 0.035 $\mu m^2$ or smaller, samples in which the standard deviation of the perimeter is 0.1 μm or larger and 0.8 μm or smaller and the average perimeter is 0.2 μm or larger and 0.9 μm or smaller, or samples in which the average aspect ratio is 1.00 or larger and 2.50 or smaller, can realize more excellent performances in both of the adhesion and the corrosion resistance. It is conceivable that this is because of the following reasons: (1) because the standard deviation of the cross-sectional area is 0.002 $\mu m^2$ or larger and 0.045 $\mu m^2$ or smaller and the average cross-sectional area is 0.035 $\mu m^2$ or larger, the standard deviation of the perimeter is 0.1 μm or larger and 0.8 μm or smaller and the average perimeter is 0.9 μm or smaller, or the average aspect ratio is 2.50 or smaller, the grain diameters of the crystal grains are relatively small as a whole, the crystal layers are formed with the more equal thickness, and the stress at the time of crimping can be more surely absorbed. (2) because the average cross-sectional area is 0.002 $\mu m^2$ or larger, the average perimeter is 0.2 μm or larger, or the average aspect ratio is 1.00 or larger, the excessive miniaturization of the crystal grain can be suppressed, and the grain boundary coupling force can be more increased.

Also, particularly, it is confirmed that samples in which the standard deviation of the cross-sectional area is 0.003 $\mu m^2$ or larger and 0.035 $\mu m^2$ or smaller and the average cross-sectional area is 0.005 $\mu m^2$ or larger and 0.025 $\mu m^2$ or smaller, samples in which the standard deviation of the perimeter is 0.2 μm or larger and 0.6 μm or smaller and the average perimeter is 0.3 μm or larger and 0.7 μm or smaller, or samples in which the average aspect ratio is 1.25 or larger and 2.10 or smaller, have the extremely excellent adhesion and corrosion resistance.

From the above test results, it is conceivable that it is preferable from the viewpoint of more improving both of the adhesion and the corrosion resistance that the standard deviation of the cross-sectional area is 0.002 $\mu m^2$ or larger and 0.045 $\mu m^2$ or smaller and the average cross-sectional area is 0.002 $\mu m^2$ or larger but 0.035 $\mu m^2$ or smaller, the standard deviation of the perimeter is 0.1 μm or larger and 0.8 μm or smaller and the average perimeter is set to 0.2 μm or larger and 0.9 μm or smaller, or the average aspect ratio is 1.00 or larger and 2.50 or smaller.

Also, for the purpose of further improving the adhesion and the corrosion resistance, it is more preferable that the standard deviation of the cross-sectional area is set to be 0.003 $\mu m^2$ or larger and 0.035 $\mu m^2$ or smaller and the average cross-sectional area is 0.005 $\mu m^2$ or larger and 0.025 $\mu m^2$ or smaller, the standard deviation of the perimeter is 0.2 μm or larger and 0.6 μm or smaller and the average perimeter is 0.3 μm or larger and 0.7 μm or smaller, or the average aspect ratio is 1.25 or larger 2.10 or smaller.

The present invention is not limited to the description of the above embodiment, but may be implemented as follows. Of course, other applications and modified examples not exemplified hereinafter can be also implemented.

(a) Impurity such as oil may be attached on a surface of the metal shell 3 before providing the nickel plating layer 31, by a rolling process in forming the threaded portion 15 on the metal shell 3. Taking this fact into consideration, before the plating process in which the above-mentioned nickel plating layer 31 is provided, a nickel strike process may be performed to the metal shell 3, and a thin-film nickel strike plating may be provided on the surface of the metal shell 3. The nickel strike process performs a barrel plating process with the use of a plating solution of a strong acidity (pH is 1 or lower) including, for example, $NiSO_4$, $NiCl_2$, $H_3BO_3$, or HCl. The impurity adhered to the surface of the metal shell 3 can be removed by performing the nickel strike process. As a result, the adhesion of the nickel plating layer 31 to the metal shell 3 can be improved, and the corrosion resistance can be further improved.

(b) Although not particularly described in the above embodiment, oil containing at least one kind of C (paraffinum liquidum), Ba, Ca, Na, and S may be coated on the surface of the nickel plating layer 31 to further improve the corrosion resistance.

(c) The above embodiment shows an example in which only the nickel plating layer 31 is provided on the surface of the metal shell 3. Alternatively, a chromate layer may be disposed on the surface of the nickel plating layer 31. In this case, the corrosion resistance can be further improved. Oil containing at least one kind of C (paraffinum liquidum), Ba, Ca, Na, and S may be coated on the surface of the chromate layer.

In addition, an anti-seizure agent containing C (paraffinum liquidum or graphite) and at least one component selected from Al, Ni, Zn, and Cu may be coated on the above-mentioned nickel plating layer 31, the chromate layer, or the oil. That is, the anti-seizure agent may be coated on the surface of the nickel plating layer 31 (the nickel strike plating may be provided, or may not be provided). Also, the anti-seizure agent may be coated on the chromate layer disposed on the surface of the nickel plating layer 31 (the nickel strike plating may be provided, or may not be provided inside of the nickel plating layer 31). The anti-seizure agent may be further coated on the oil coated on the nickel plating layer 31, disposed on the surface of the nickel plating layer 31 or the chromate layer (the nickel strike plating may be provided, or may not be provided inside of the nickel plating layer 31).

(d) In the above embodiment, a case in which the ground electrode 27 is joined to the front end portion of the metal shell 3 is embodied. However, the present invention can be also applied to a case in which the ground electrode is formed by grinding a part of the metal shell (or a part of a tip fitting welded to the metal shell in advance) (for example, JP-A-2006-236906).

(e) In the above embodiment, the tool engaging portion 19 is formed into a hexagonal cross-sectional shape. However, the shape of the tool engaging portion 19 is not limited to the above shape. For example, the shape may be a Bi-HEX (12 angle deformation) shape [ISO 22977:2005 (E)].

| List of Reference Signs | |
|---|---|
| 1 | spark plug |
| 3 | metal shell (spark plug metal shell) |
| 31 | nickel plating layer |
| CL1 | axis |

Having described the invention, the following is claimed:

1. A spark plug comprising:

a cylindrical metal shell that extends in an axial direction; and a nickel plating layer that is made of metal containing nickel as a main component and covers an outer surface of the metal shell, wherein in a monochrome image of 256 gradations where black is 0 and white is 255, which is obtained by observing a cross-section perpendicular to an outer surface of the nickel plating layer by a transmission electron microscope with an acceleration voltage of 200 kV, an average value in the 256 gradations of the monochrome image is 170 or larger and 230 or smaller.

2. The spark plug according to claim 1, wherein in the cross-section perpendicular to the outer surface of the nickel plating layer, an average value of cross-sectional areas of respective crystal grains configuring the nickel plating layer is 0.002 $\mu m^2$ or larger and 0.035 $\mu m^2$ or smaller and a standard deviation of the cross-sectional areas of the respective crystal grains is 0.002 $\mu m^2$ or larger and 0.045 $\mu m^2$ or smaller.

3. The spark plug according to claim 1, wherein in the cross-section perpendicular to the outer surface of the nickel plating layer, an average value of lengths of outlines of the respective crystal grains configuring the nickel plating layer is 0.2 μm or larger and 0.9 μm or smaller and a standard deviation of the lengths of the outlines of the respective crystal grains is 0.1 μm or larger and 0.8 μm or smaller.

4. The spark plug according to claim 1, wherein in the cross-section perpendicular to the outer surface of the nickel plating layer, an average value of aspect ratios, which are obtained by dividing a major axis by a minor axis in a cross-section for each of the crystal grains configuring the nickel plating layer, is 1.00 or larger and 2.50 or smaller.

5. A metal shell for a spark plug, the metal shell assuming a cylindrical shape, extending in an axial direction, and comprising:

a nickel plating layer that is made of metal containing nickel as a main component, and covers an outer surface of the metal shell, wherein in a monochrome image of 256 gradations where black is 0 and white is 255, which is obtained by observing a cross-section perpendicular to an outer surface of the nickel plating layer by a transmission electron microscope with an acceleration voltage of 200 kV, an average value in the 256 gradations of the monochrome image is 170 or larger and 230 or smaller.

6. The metal shell for a spark plug according to claim 5, wherein in the cross-section perpendicular to the outer surface of the nickel plating layer, an average value of cross-sectional areas of respective crystal grains configuring the nickel plating layer is 0.002 $\mu m^2$ or larger and 0.035 $\mu m^2$ or smaller and a standard deviation of the cross-sectional areas of the respective crystal grains is 0.002 $\mu m^2$ or larger and 0.045 $\mu m^2$ or smaller.

7. The metal shell for a spark plug according to claim 5, wherein in the cross-section perpendicular to the outer surface of the nickel plating layer, an average value of lengths of outlines of the respective crystal grains configuring the nickel plating layer is 0.2 μm or larger and 0.9 μm or smaller and a standard deviation of the lengths of the outlines of the respective crystal grains is 0.1 μm or larger and 0.8 μm or smaller.

8. The metal shell for a spark plug according to claim 5, wherein in the cross-section perpendicular to the outer surface of the nickel plating layer, an average value of aspect ratios, which are obtained by dividing a major axis by a minor axis in a cross-section for each of the crystal grains configuring the nickel plating layer, is 1.00 or larger and 2.50 or smaller.

* * * * *